US010145367B2

(12) United States Patent
Ishikawa et al.

(10) Patent No.: US 10,145,367 B2
(45) Date of Patent: Dec. 4, 2018

(54) PISTON PUMP AND VALVE PLATE OF PISTON PUMP

(71) Applicant: KYB Corporation, Tokyo (JP)

(72) Inventors: Ryunosuke Ishikawa, Kanagawa (JP); Yoshihiro Oobayashi, Kanagawa (JP)

(73) Assignee: KYB Corporation, Tokyo (JP)

( * ) Notice: Subject to any disclaimer, the term of this patent is extended or adjusted under 35 U.S.C. 154(b) by 193 days.

(21) Appl. No.: 15/123,933

(22) PCT Filed: Jun. 4, 2015

(86) PCT No.: PCT/JP2015/066198

§ 371 (c)(1),
(2) Date: Sep. 6, 2016

(87) PCT Pub. No.: WO2015/190397

PCT Pub. Date: Dec. 17, 2015

(65) Prior Publication Data

US 2017/0016432 A1 Jan. 19, 2017

(30) Foreign Application Priority Data

Jun. 12, 2014 (JP) ..... 2014-121314

(51) Int. Cl.

| | |
|---|---|
| ***F04B 23/06*** | (2006.01) |
| ***F04B 1/22*** | (2006.01) |
| ***F04B 27/08*** | (2006.01) |
| ***F04B 1/12*** | (2006.01) |
| ***F04B 1/20*** | (2006.01) |
| ***F04B 53/14*** | (2006.01) |
| ***F04B 53/16*** | (2006.01) |

(52) U.S. Cl.
CPC ..... *F04B 1/22* (2013.01); *F04B 1/126* (2013.01); *F04B 1/2042* (2013.01); *F04B 1/2078* (2013.01); *F04B 23/06* (2013.01); *F04B 27/08* (2013.01); *F04B 53/14* (2013.01); *F04B 53/162* (2013.01)

(58) Field of Classification Search
CPC .... F04B 1/20; F04B 1/22; F04B 27/08; F04B 1/2078
See application file for complete search history.

(56) References Cited

U.S. PATENT DOCUMENTS

| | | | | |
|---|---|---|---|---|
| 4,027,853 | A | 6/1977 | Linnert | |
| 6,186,748 | B1 * | 2/2001 | Umeda | F04B 1/2042 417/269 |
| 2004/0016230 | A1 | 1/2004 | Hale | |

FOREIGN PATENT DOCUMENTS

| | | | |
|---|---|---|---|
| JP | H0389986 | U | 9/1991 |
| JP | H08-247021 | A | 9/1996 |
| JP | 2005-240650 | A | 9/2005 |

* cited by examiner

*Primary Examiner* — Patrick Hamo
(74) *Attorney, Agent, or Firm* — Rabin & Berdo, P.C.

(57) ABSTRACT

A piston pump configured to suction and discharge a working fluid includes a plurality of pistons, a cylinder block accommodating the pistons, a shaft combined with the cylinder block, swash plate configured to reciprocate the pistons in accordance with rotation of the cylinder block, a casing accommodating the cylinder block, and a valve plate placed between the cylinder block and the casing. The valve plate has a suction port providing communication between capacity chambers and a suction passage, and the suction port is a cutout part formed by cutting out an outer edge of the valve plate.

7 Claims, 3 Drawing Sheets

PISTON PUMP AND VALVE PLATE OF PISTON PUMP

TECHNICAL FIELD

The present invention relates to a piston pump adapted to suction and discharge a working fluid, and a valve plate of the same.

BACKGROUND ART

As a piston pump adapted to suction and discharge a working fluid, for example, a piston pump as described in JP 8-247021 A is known. JP 8-247021 A discloses a hydraulic axial piston pump having a valve plate in which a suction port and a discharge port are formed, the hydraulic axial piston pump adapted to suction and discharge water as a working fluid.

SUMMARY OF INVENTION

In the piston pump as described in JP 8-247021 A, the working fluid is suctioned through the suction port formed in the valve plate. However, when flow passage resistance of the suction port is large, especially at the time of high rotation operation, the working fluid is not easily suctioned. Thus, there is a fear that a suctioning performance is deteriorated and pump efficiency is lowered.

An object of the present invention is to reduce flow passage resistance of a suction port in a piston pump and improve pump efficiency.

According to one aspect of the present invention, a piston pump configured to suction and discharge a working fluid is provided. The piston pump includes: a plurality of pistons; a cylinder block including a plurality of cylinders configured to accommodate the pistons, the cylinder block being configured to be rotated; a shaft configured to pass through the cylinder block, the shaft being combined with the cylinder block; a swash plate configured to reciprocate the pistons in such a manner that capacity chambers of the cylinders are expanded and contracted in accordance with rotation of the cylinder block; a casing configured to accommodate the cylinder block and support the shaft; and a valve plate placed between the cylinder block and the casing. The cylinder block has communication holes configured to be opened on the cylinders, the casing has a suction passage through which the working fluid is guided to the capacity chambers through the communication holes, and a discharge passage to which the working fluid discharged from the capacity chambers through the communication holes is guided, the valve plate has a suction port configured to allow communication between the communication holes and the suction passage, and a discharge port configured to allow communication between the communication holes and the discharge passage, and the suction port is a cutout part formed by cutting out an outer edge of the valve plate.

According to another aspect of the present invention, a piston pump configured to suction and discharge a working fluid is provided. The piston pump includes: a plurality of pistons; a cylinder block including a plurality of cylinders configured to accommodate the pistons, the cylinder block being configured to be rotated; a shaft configured to pass through the cylinder block, the shaft being combined with the cylinder block; a swash plate configured to reciprocate the pistons in such a manner that capacity chambers of the cylinders are expanded and contracted in accordance with rotation of the cylinder block; a casing configured to accommodate the cylinder block and support the shaft; and a valve plate placed between the cylinder block and the casing. The cylinder block has communication holes configured to be opened on the cylinders, the casing has a suction passage through which the working fluid is guided to the capacity chambers through the communication holes, and a discharge passage to which the working fluid discharged from the capacity chambers through the communication holes is guided, the valve plate has a suction port configured to allow communication between the communication holes and the suction passage, and a discharge port configured to allow communication between the communication holes and the discharge passage, the suction port is a through hole having an inner circumferential surface defining a radially inner side of the suction port, and an outer circumferential surface provided on the radially outer side of the inner circumferential surface, and the outer circumferential surface is provided on the radially outer side of an outer end of a trajectory on which the communication holes go in accordance with the rotation of the cylinder block.

According to another aspect of the present invention, a valve plate provided in a piston pump, the valve plate being placed between a cylinder block in which a cylinder configured to accommodate a piston is formed, the cylinder block being configured to be rotated together with a shaft, and a casing in which a suction passage through which a working fluid is guided into the cylinder and a discharge passage to which the working fluid discharged from the cylinder is guided are formed, the casing being configured to accommodate the cylinder block is provided. The valve plate includes: a suction port connected to the suction passage; and a discharge port connected to the discharge passage. The suction port is a cutout part formed by cutting out an outer edge of the valve plate.

According to another aspect of the present invention, a valve plate provided in a piston pump, the valve plate being placed between a cylinder block in which a cylinder configured to accommodate a piston is formed and a communication hole configured to be opened on the cylinder is formed, the cylinder block configured to be rotated together with a shaft, and a casing in which a suction passage through which a working fluid is guided into the cylinder and a discharge passage to which the working fluid discharged from the cylinder is guided are formed, the casing being configured to accommodate the cylinder block is provided. The valve plate includes: a suction port configured to allow communication between the suction passage and the communication hole, the suction port having an inner circumferential surface and an outer circumferential surface; and a discharge port configured to allow communication between the discharge passage and the communication hole. The outer circumferential surface of the suction port is provided on the radially outer side of an outer end of a trajectory on which the communication hole goes in accordance with rotation of the cylinder block.

DESCRIPTION OF EMBODIMENTS

Hereinafter, a piston pump according to an embodiment of the present invention will be described with reference to the drawings. In the present embodiment, a case where the piston pump is a piston pump 100 in which water serves as a working fluid will be described.

Figure 1:
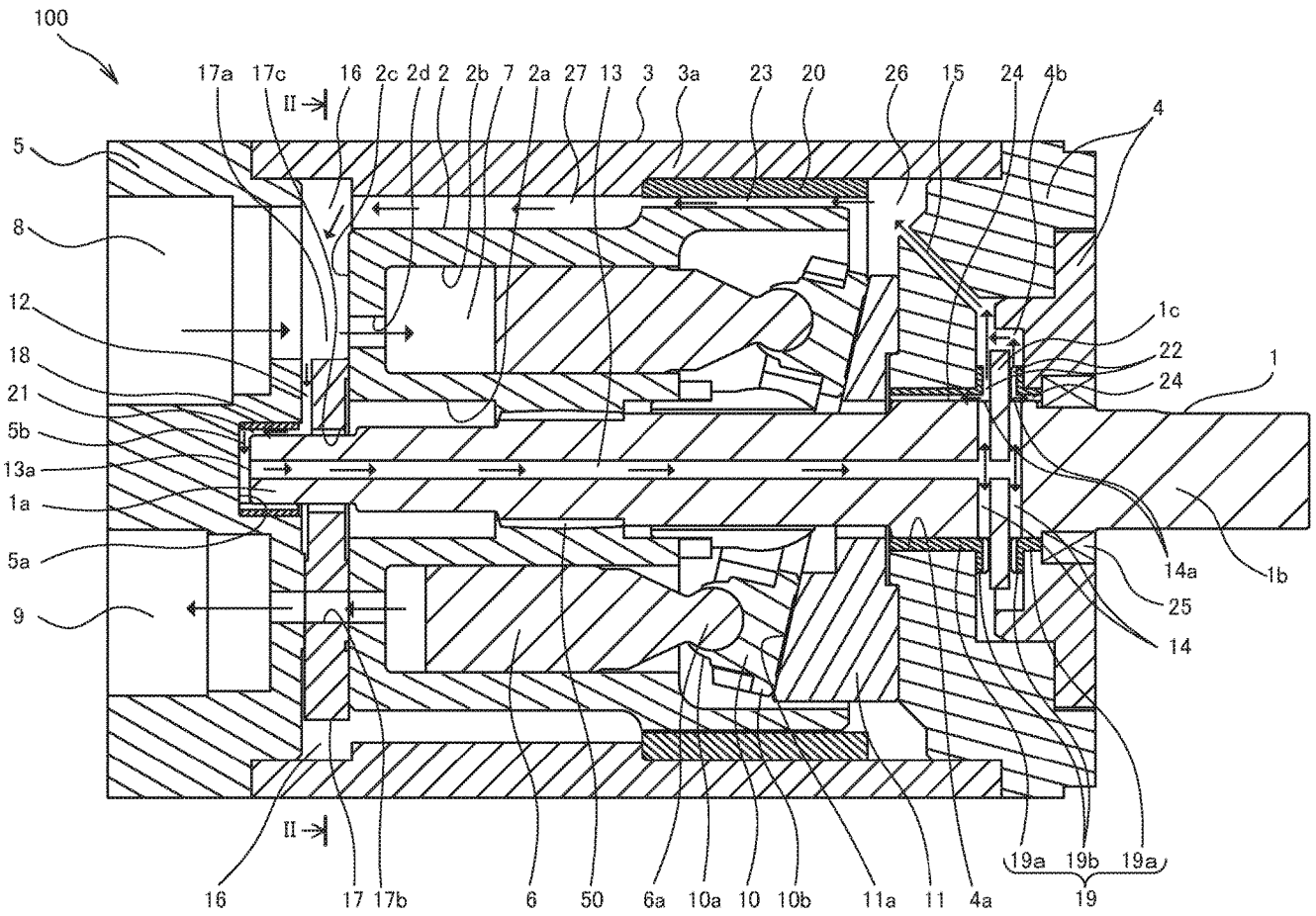
FIG. 1 is a sectional view of a piston pump according to an embodiment of the present invention.

As shown in FIG. 1, the piston pump 100 includes a shaft 1 to be rotated by a power source, a cylinder block 2 coupled to the shaft 1, the cylinder block to be rotated in accordance with rotation of the shaft 1, and a casing 3 accommodating the cylinder block 2. The casing 3 includes a case main body 3*a* whose both ends are opened, an end cover 5 supporting one end of the shaft 1 and closing one opening end of the case main body 3*a*, and a front cover 4 through which the other end of the shaft 1 is inserted, the front cover closing the other opening end of the case main body 3*a*.

The shaft 1 has a flange portion 1*c* formed to project in a radially annular shape from an outer circumferential surface in a part of the shaft to be inserted through the front cover 4. The flange portion 1*c* is accommodated in the front cover 4, and axially relative movement of the shaft 1 and the front cover 4 is regulated. One end portion 1*a* of the shaft 1 is accommodated in an accommodation recessed portion 5*a* provided in the end cover 5. The other end portion 1*b* of the shaft 1 projects to an exterior from the front cover 4, and is coupled to the power source.

The cylinder block 2 has a through hole 2*a* through which the shaft 1 passes, and is splined to the shaft 1 at a coupling portion 50. Thereby, the cylinder block 2 is rotated in accordance with the rotation of the shaft 1.

In the cylinder block 2, plural cylinders 2*b* having opening parts on one end surface, the cylinders being formed in parallel to the shaft 1, and communication holes 2*d* having opening parts on the other end surface and interiors of the cylinders 2*b* are formed. The plural cylinders 2*b* are formed at predetermined intervals in the circumferential direction of the cylinder block 2. A columnar piston 6 defining a capacity chamber 7 is reciprocatively inserted into each of the cylinders 2*b*. A leading end side of the piston 6 projects from an opening part of the cylinder 2*b*, and a spherical base 6*a* is formed in a leading end part thereof. Each of the communication holes 2*d* provides communication between the capacity chamber 7, and a suction port 17*a* and a discharge port 17*b* to be described later, alternately. In the present embodiment, the communication hole 2*d* is a circular hole. A shape of the communication hole 2*d* is not limited to this but may be any shape such as an oval shape or a rectangular shape.

As shown in FIG. 1, the piston pump 100 further includes shoes 10 rotatably coupled to the spherical bases 6*a* of the pistons 6, and swash plate 11 with which the shoes 10 are brought into sliding contact in accordance with the rotation of the shaft 1.

Each of the shoes 10 includes a receiving portion boa receiving the spherical base 6*a* formed in a leading end of the piston 6, and a circular flat plate portion 10*b* to be brought into sliding contact with the swash plate 11. An inner surface of the receiving portion boa is formed in a spherical shape, and brought into sliding contact with an outer surface of the received spherical base 6*a*. Thereby, an angle of the shoe 10 with respect to the spherical base 6*a* can be changed in any directions.

The swash plate 11 fixed to an inner wall of the front cover 4 and has a sliding contact surface 11*a* inclined from the direction perpendicular to an axis of the shaft 1. The flat plate portion 10*b* of the shoe 10 is brought into surface contact with the sliding contact surface 11*a*.

The case main body 3*a* rotatably supports the cylinder block 2 via a third bearing 20. The third bearing 20 is a plain bearing to be fitted to an inner circumferential surface of the case main body 3*a*.

In the front cover 4, a guiding passage 15 communicating with an interior of the case main body 3*a*, a through hole 4*a* through which the shaft 1 is inserted, and an accommodation portion 4*b* accommodating the flange portion 1*c* of the shaft 1 are formed. In the through hole 4*a* and the accommodation portion 4*b*, a second bearing 19 rotatably supporting the shaft 1 and the flange portion 1*c* is accommodated.

The second bearing 19 includes a pair of cylindrical portions 19*a* placed between the front cover 4 and the shaft 1, and a pair of annular portions 19*b* placed between the front cover 4 and the flange portion 1*c*, the annular portions 19*b* projecting in a radially annular shape respectively from end parts of the pair of cylindrical portions 19*a*. The pair of cylindrical portions 19*a* rotatably supports the shaft 1. The pair of annular portions 19*b* is formed to nip the flange portion 1*c* from both sides and rotatably supports the flange portion 1*c* by facing surfaces facing each other. In such a way, the front cover 4 rotatably supports the shaft 1 via the second bearing 19.

In the end cover 5, a suction passage 8 through which water suctioned into the capacity chamber 7 through the communication hole 2*d* is guided, and a discharge passage 9 through which water discharged from the capacity chamber 7 through the communication hole 2*d* is guided are formed. The end cover 5 further rotatably supports the shaft 1 via a first bearing 18 arranged in the accommodation recessed portion 5*a*. The first bearing 18 is a plain bearing to be fitted to an inner circumferential surface of the accommodation recessed portion 5*a*.

The piston pump 100 further includes a valve plate 17 placed between the cylinder block 2 and the end cover 5.

Figure 2:
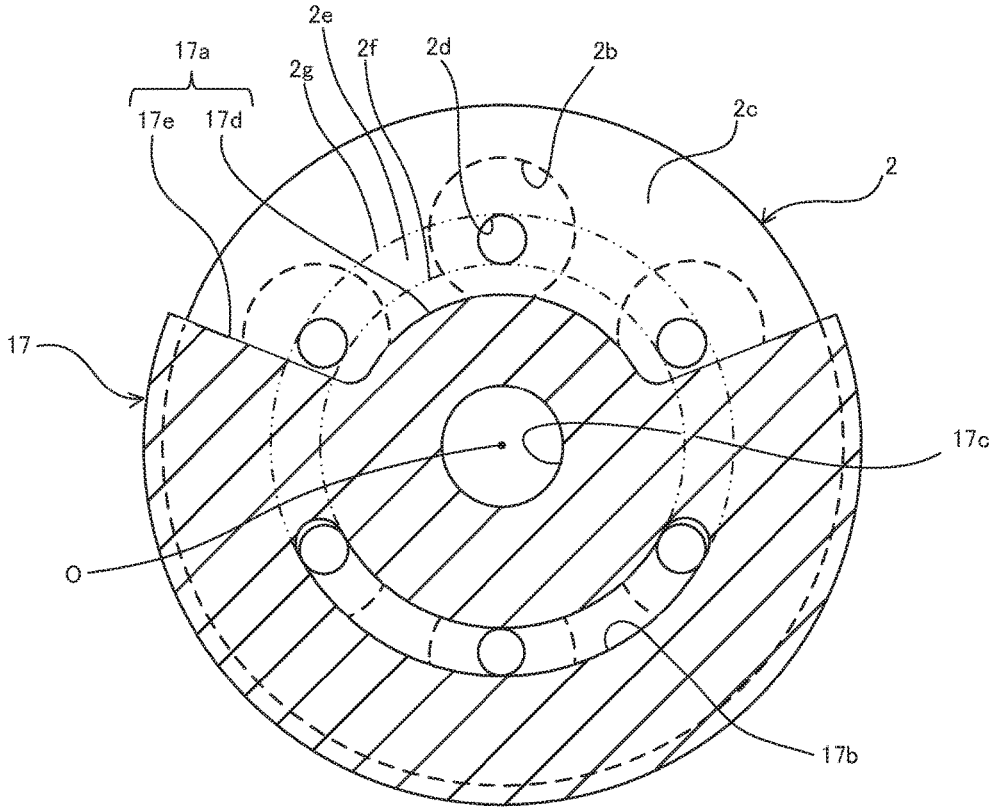
FIG. 2 is a sectional view taken along the line II-II in FIG. 1.

As shown in FIGS. 1 and 2, the valve plate 17 is a disc member with which a base end surface 2*c* of the cylinder block 2 is brought into sliding contact, and is fixed to the end cover 5. FIG. 2 is a sectional view showing a section taken along the line II-II in FIG. 1, in which members other than the valve plate 17 and the cylinder block 2 are omitted. In the valve plate 17, the suction port 17*a* and the discharge port 17*b* are formed, and a through hole 17*c* having a circular portion, the through hole through which the shaft 1 passes is formed on the inner side of the suction port 17*a* and the discharge port 17*b*.

As shown in FIG. 2, the communication holes 2*d* go on a communication hole trajectory 2*e* sandwiched between an outer end trajectory 2*g* on which the most distant points on the communication holes 2*d* when seen from rotation center O of the cylinder block 2 go in accordance with rotation of the cylinder block 2, and an inner end trajectory 2*f* on which the nearest points on the communication holes 2*d* when seen from the rotation center O of the cylinder block 2 go in accordance with the rotation of the cylinder block 2. The suction port 17*a* provides communication between the communication holes 2*d* on the communication hole trajectory 2*e* in the suction port 17*a* and the suction passage 8 formed in the end cover 5, and the discharge port 17*b* provides communication between the communication holes 2*d* on the communication hole trajectory 2*e* in the discharge port 17*b* and the discharge passage 9 formed in the end cover 5.

The suction port 17*a* in the present embodiment is a cutout part formed by cutting out an outer edge of the valve plate 17. The suction port 17*a* is defined by an inner circumferential surface 17*d* concentric with the through hole 17*c*, the inner circumferential surface extending in an arc shape, and two side surfaces 17*e* extending toward center of the through hole 17*c* from the outer edge of the valve plate 17.

The inner circumferential surface 17*d* of the suction port 17*a* is provided on the radially inner side of the inner end trajectory 2*f* of the communication holes 2*d*. Further, an inner circumferential surface (not shown) of the suction passage 8 formed in the end cover 5 is provided at the radially same position as or on the radially inner side of the inner circumferential surface 17*d* of the suction port 17*a*. In such a way, no narrow parts are set in a flow passage running from the suction passage 8 to the communication holes 2*d*. Thus, resistance given to the working fluid suctioned into the capacity chambers 7 through the suction passage 8, the suction port 17*a*, and the communication holes 2*d* is reduced.

The side surfaces 17*e* are not limited to surfaces extending toward the center of the through hole 17*c* but may be surfaces in any directions as long as the surfaces extend from the outer edge of the valve plate 17 and reach the inner circumferential surface 17*d* and is capable of defining the cutout shape suction port 17*a* together with the inner circumferential surface 17*d*. Circumferential length of the suction port 17*a* is set in accordance with length from a suction start point to a suction end point as well as a conventional suction port of a piston pump. The circumferential length of the suction port 17*a* is not limited to this but may be set to be longer than the length from the suction start point to the suction end point.

The discharge port 17*b* is an arc shape long hole extending concentrically with the through hole 17*c*. In the present embodiment, the discharge port 17*b* is one long hole but may be formed to be divided into plural parts in the circumferential direction.

Next, actions of the piston pump 100 will be described.

When the shaft 1 is driven and rotated by power from an exterior and the cylinder block 2 is accordingly rotated, the flat plate portions 10*b* of the shoes 10 are brought into sliding contact with the swash plate 11, and the pistons 6 are reciprocated in the cylinders 2*b* by a stroke amount in accordance with inclination angle of the swash plate 11. By reciprocating movement of the pistons 6, capacities of the capacity chambers 7 are increased or reduced.

The water is guided to the capacity chamber 7 expanded by the rotation of the cylinder block 2 through the suction passage 8, the suction port 17*a*, and the communication hole 2*d*. Pressure of the water suctioned into the capacity chamber 7 is boosted by contraction of the capacity chamber 7 by the rotation of the cylinder block 2, and the water is discharged through the communication hole 2*d*, the discharge port 17*b*, and the discharge passage 9. In such a way, in the piston pump 100, the water is continuously suctioned and discharged in accordance with the rotation of the cylinder block 2.

Next, a configuration of a circulation passage of the piston pump 100 will be described.

Between the valve plate 17 and the end cover 5, an introduction passage 12 providing communication between the suction passage 8 and the accommodation recessed portion 5*a* is formed. The introduction passage 12 is formed on a surface of the valve plate 17 abutted with the end cover 5. The introduction passage 12 is formed as a radial groove extending in a groove shape in the radial direction. At least one introduction passage 12 may be formed on the surface of the valve plate 17 abutted with the end cover 5.

A first connection passage 21 serving as a groove providing communication between the introduction passage 12 and an internal space 5*b* of the accommodation recessed portion 5*a* extends in the axial direction on an inner circumferential surface of the first bearing 18 arranged in the accommodation recessed portion 5*a*. Therefore, the introduction passage 12 communicates with the internal space 5*b* through the first connection passage 21, and a part of water of the suction passage 8 is guided to the accommodation recessed portion 5*a* of the end cover 5.

In the shaft 1, an axial passage 13 having an inflow port 13*a* opened on a leading end surface and being pierced on axial center of the shaft 1, and radial passages 14 being pierced in the radial direction of the shaft 1 from the axial passage 13 and having outflow ports 14*a* opened on the outer circumferential surface of the shaft 1 which faces the front cover 4 are formed. The inflow port 13*a* communicates with the internal space 5*b* of the accommodation recessed portion 5*a*. Therefore, the introduction passage 12 and the axial passage 13 communicate with each other, and the water guided from the introduction passage 12 is guided to the axial passage 13 through the inflow port 13*a*.

The axial passage 13 is a non-through hole pierced in the axial direction of the shaft 1 so as to extend from the inflow port 13*a* and pass through the axial center. The radial passages 14 are through holes communicating with the axial passage 13, being opened on the outer circumferential surface of the shaft 1 which faces the front cover 4, and being pierced in the radial direction. In the present embodiment, the two radial passages 14 opened at positions facing the pair of cylindrical portions 19*a* of the second bearing 19 are provided.

Second connection passages 22 serving as radial grooves extending in a groove shape in the radial direction are formed on facing surfaces of the pair of annular portions 19*b* of the second bearing 19. The second connection passages 22 communicate with the guiding passage 15 via the accommodation portion 4*b* of the front cover 4.

Fourth connection passages 24 serving as axial grooves extending in a groove shape in the axial direction are formed on inner circumferential surfaces of the cylindrical portions 19*a* of the second bearing 19. The fourth connection passages 24 are formed to provide communication between the radial passages 14 and the second connection passages 22. Therefore, the radial passages 14 communicate with the guiding passage 15 through the fourth connection passages 24 and the second connection passages 22. Thus, the water guided to the axial passage 13 passes through the axial passage 13 and then is discharged from the outflow ports 14*a* of the radial passages 14 and guided to the guiding passage 15 through the fourth connection passages 24 and the second connection passages 22. A seal member 25 is provided in the front cover 4 so that the water is not leaked out to the exterior from a part between the shaft 1 and the front cover 4. Therefore, the water is not leaked out to the exterior through the fourth connection passages 24.

The guiding passage 15 is provided in the front cover 4 so as to communicate with the interior of the case main body 3*a*. Therefore, the water guided through the second connection passages 22 is guided to the interior of the case main body 3*a* through the guiding passage 15.

A third connection passage 23 serving as an axial groove extending in a groove shape in the axial direction is formed on an inner circumferential surface of the third bearing 20. In the casing main body 3*a*, a front side chamber 26 and an end side chamber 27 are defined across the third bearing 20. The third connection passage 23 allows passage of water of the front side chamber 26 and the end side chamber 27.

Between the valve plate 17 and the case main body 3*a*, a return passage 16 providing communication between the suction passage 8 and the end side chamber 27 is formed. The return passage 16 is a gap formed between an outer circumferential surface of the valve plate 17 including the inner circumferential surface 17*d* and the side surfaces 17*e*, and the inner circumferential surface of the case main body 3*a*. A part of the return passage 16 is common to the suction port 17*a*. Thus, the water of the end side chamber 27 is guided to the suction passage 8 through the return passage 16 and the suction port 17*a*.

Next, circulation of the working fluid in the piston pump 100 will be described with reference to FIG. 1.

As shown by arrows in FIG. 1, the water serving as the working fluid is circulated in the above circulation passage. The front side chamber 26 and the end side chamber 27 defined between the casing 3 and the cylinder block 2 in the piston pump 100 are filled with the water serving as the working fluid. When the shaft 1 is rotated, centrifugal force following rotation is applied to water in the radial passages 14 provided in the radial direction of the shaft 1. The water in the radial passages 14 is pushed out toward an outer periphery of the shaft 1 by the centrifugal force due to rotation of the shaft 1 and discharged from the outflow ports 14*a*. Since the water in the radial passages 14 is discharged by the centrifugal force, pressure in the radial passages 14 is lowered. Thus, the water in the axial passage 13 is suctioned into the radial passages 14.

With suctioning of the water in the axial passage 13 into the radial passages 14, pressure is lowered also in the inflow port 13*a*. Therefore, a part of the water passing through the suction passage 8 is suctioned through the introduction passage 12, the first connection passage 21, and the internal space 5*b* of the accommodation recessed portion 5*a*, and guided into the axial passage 13 from the inflow port 13*a*.

Meanwhile, the water discharged from the outflow ports 14*a* is guided to the guiding passage 15 through the fourth connection passages 24 and the second connection passages 22. Since the guiding passage 15 communicates with the front side chamber 26, the water discharged from the outflow ports 14*a* is guided to the front side chamber 26.

The front side chamber 26 and the end side chamber 27 inside the case main body 3*a* communicate with each other through the third connection passage 23. Therefore, the water guided to the front side chamber 26 is guided to the end side chamber 27 through the third connection passage 23.

Since the end side chamber 27 and the suction passage 8 communicate with each other through the return passage 16, the water guided to the end side chamber 27 is returned to the suction passage 8 through the return passage 16.

As described above, the water is guided from the suction passage 8 to the axial passage 13, and the guided water passes through an interior of the shaft 1 and is discharged from the radial passages 14 by the centrifugal force due to rotation of the shaft 1. The discharged water passes through the interior of the case main body 3*a* and is discharged to the suction passage 8 through the return passage 16.

In such a way, in the piston pump 100, the water is guided to the interiors of the shaft 1 and the bearings and circulated. Thus, members where the circulation passage is provided can be cooled down. The circulated water also functions as a lubricant of sliding contact surfaces of the first, second, and third bearings 18, 19, 20.

According to the above embodiment, the following effects are exerted.

Since the suction port 17*a* is the cutout part formed by cutting out the outer edge of the valve plate 17 and has sufficient size in the radial direction, the resistance given to the working fluid suctioned into the capacity chambers 7 through the suction port 17*a* is reduced in comparison to a case where the suction port 17*a* is formed by a long hole. As a result, with the piston pump 100, the working fluid is easily suctioned, a pressure loss can be reduced, and pump efficiency can be improved.

Since the inner circumferential surface 17*d* defining the suction port 17*a* is provided on the radially inner side of the inner end trajectory 2*f* of the communication holes 2*d*, the resistance given to the working fluid suctioned into the capacity chambers 7 through the communication holes 2*d* can be reduced. Further, since the inner circumferential surface of the suction passage 8 formed in the end cover 5 is provided on the radially inner side of the inner circumferential surface 17*d* of the suction port 17*a*, the resistance given to the working fluid suctioned into the capacity chambers 7 through the suction passage 8, the suction port 17*a*, and the communication holes 2*d* can be reduced.

Since the suction port 17*a* is the cutout part formed by cutting out the outer edge of the valve plate 17, in comparison to a case where the suction port is formed by a long hole, weight of the valve plate 17 is decreased. Thus, weight of the entire pump can be reduced.

In a case where particularly the water is used as the working fluid, and when suctioning resistance is increased, cavitation is easily generated and the maximum rotating speed of the piston pump 100 is restricted. According to the present embodiment, flow passage resistance of the suction port 17*a* can be reduced. Thus, generation of cavitation can be suppressed and the maximum rotating speed of the piston pump 100 can be increased. Further, a discharge flow rate is increased in accordance with the increase in the maximum rotating speed. Thus, a pump performance of the piston pump 100 can be improved. In addition, by the reduction in the flow passage resistance of the suction port 17*a*, noises due to the suctioning resistance are lowered. Thus, operation noises of the piston pump 100 can be lowered.

The suction port 17*a* reaching the outer edge of the valve plate 17 is utilized as the return passage 16 of the circulation passage. Thus, the working fluid returned from the circulation passage is smoothly returned to the suction passage 8. Therefore, the working fluid is not accumulated in the circulation passage. Thus, the bearings 18, 19, 20 arranged in the piston pump 100 and the splined portion can be efficiently cooled down by the working fluid flowing through the circulation passage. In addition, the working fluid also functions as the lubricant of the sliding contact surfaces of the bearings 18, 19, 20. Thus, wear of the sliding contact surfaces is reduced, and the life of the bearings 18, 19, 20 can be improved.

Figure 3:
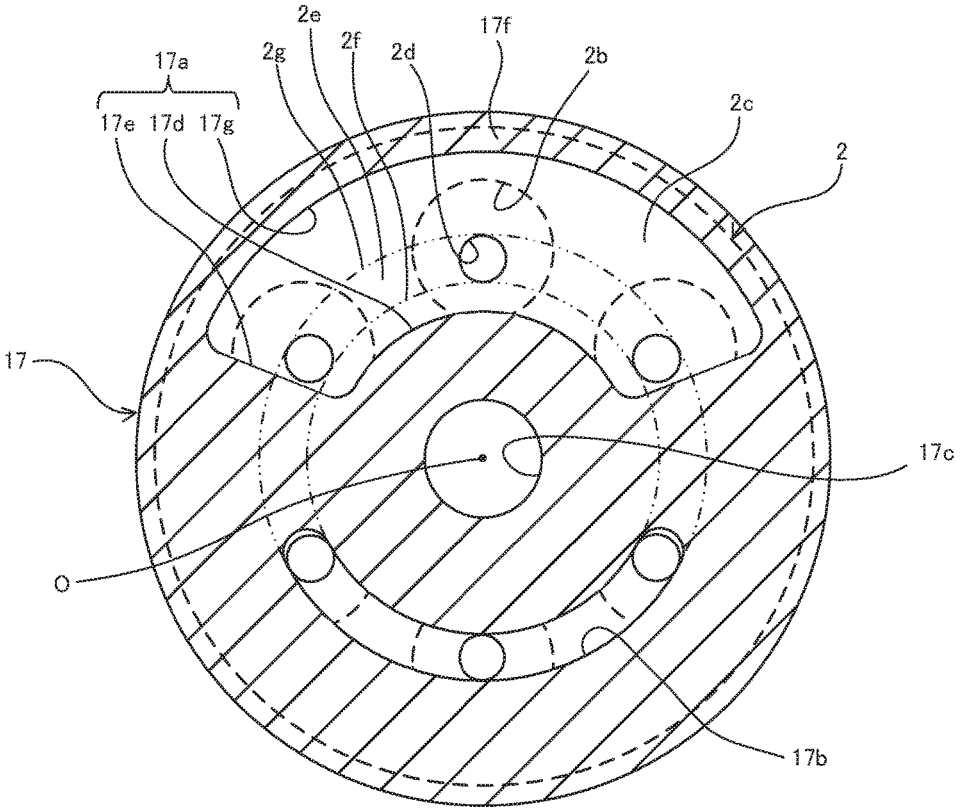
FIG. 3 is a sectional view of a modified example of a valve plate.

Next, a modified example of the valve plate 17 will be described with reference to FIG. 3. Hereinafter, points different from the above embodiment will be mainly described, and parts having the same configurations will be given the same reference signs and description thereof will be omitted. FIG. 3 shows a sectional view taken along the line II-II as well as FIG. 2. The parts other than a valve plate 17 have the same configurations as the above embodiment.

In comparison to the above embodiment, a suction port 17*a* in the modified example has an outer circumferential surface 17*g* formed on the radially outer side of an inner circumferential surface 17*d*, and the suction port 17*a* is defined by this outer circumferential surface 17*g*, the inner circumferential surface 17*d*, and two side surfaces 17*e*.

Specifically, in the valve plate 17, a connecting portion 17*f* connecting the two side surfaces 17*e* on the radially outer side of the inner circumferential surface 17*d*, the connecting portion 17*f* having the outer circumferential surface 17*g* is provided. A base end surface 2*c* of a cylinder block 2 is brought into sliding contact with a surface of the connecting portion 17*f* on the side of the cylinder block 2.

The inner circumferential surface 17*d* of the suction port 17*a* is provided on the radially inner side of an inner end trajectory 2*f* of communication holes 2*d* as well as the above embodiment. Meanwhile, the outer circumferential surface 17*g* is provided on the radially outer side of an outer end trajectory 2*g* of the communication holes 2*d*. That is, the connecting portion 17*f* having the outer circumferential surface 17*g* is formed at a position not to cover the communication holes 2*d*. In such a way, no narrow parts are provided in a flow passage on the upstream side of the communication holes 2*d*. Thus, resistance given to a working fluid suctioned into capacity chambers 7 through the communication holes 2*d* is reduced.

The side surfaces 17*e* are not limited to surfaces extending toward the center of the through hole 17*c* but may be surfaces in any directions as long as the surfaces extend from the outer circumferential surface 17*g* and reach the inner circumferential surface 17*d* and is capable of defining the suction port 17*a* together with the inner circumferential surface 17*d* and the outer circumferential surface 17*g*. The connecting portion 17*f* may connect the side surfaces 17*e* in any ways as long as the base end surface 2*c* of the cylinder block 2 can be brought into sliding contact with the coupling portion and the coupling portion does not cover a part of the communication holes 2*d*. A passage providing communication between an outer circumferential side of the connecting portion 17*f* and a side of the suction port 17*a* may be formed in an interior or on a surface of the connecting portion 17*f*. This passage serves as a return passage 16 providing communication between a suction passage 8 and an end side chamber 27.

According to the above modified example, the same effects as the above embodiment are exerted, and the following effects are also exerted.

The outer circumferential surface 17*g* of the suction port 17*a* is provided on the radially outer side of an outer end of a communication hole trajectory 2*e* on which the communication holes 2*d* go in accordance with rotation of the cylinder block 2, and the suction port 17*a* has sufficient size in the radial direction. Thus, the resistance given to the working fluid suctioned into the capacity chambers 7 through the suction port 17*a* is reduced in comparison to a case where the suction port 17*a* is formed by a long hole. As a result, with the piston pump 100, the working fluid is easily suctioned, a pressure loss can be reduced, and pump efficiency can be improved.

The connecting portion 17*f* with which the base end surface 2*c* of the cylinder block 2 can be brought into sliding contact is provided between the side surfaces 17*e* defining the suction port 17*a*. Therefore, a decrease in contact surface pressure between the valve plate 17 and the cylinder block 2 is suppressed and wear of the valve plate 17 and the cylinder block 2 can be prevented. Further, an outer circumferential side of the cylinder block 2 is always in contact with the valve plate 17, oscillation of the cylinder block 2 can be suppressed.

Embodiments of the present invention were described above, but the above embodiments are merely examples of applications of the present invention, and the technical scope of the present invention is not limited to the specific constitutions of the above embodiments.

For example, in the above embodiment, a case where the water is used as the working fluid is described. However, instead of this, a working fluid such as working oil and a soluble replacement solution may be used. The piston pump 100 is of a type where an angle of the swash plate 11 is fixed but may be a variable capacity type piston pump where a tilting angle of swash plate can be changed.

Further, in the above embodiment, a case where the introduction passage 12 is formed in the valve plate 17 is described. Instead of this, the introduction passage 12 may be formed in the end cover 5. In this case, a groove may be formed on a surface of the end cover 5 in contact with the valve plate 17, or a port connecting the suction passage 8 and the accommodation recessed portion 5*a* may be pierced.

Further, in the above embodiment, a case where the working fluid circulated through the circulation passage is supplied from the suction passage 8 is described. Instead of this, the working fluid may be supplied from the discharge passage 9. In this case, the introduction passage 12 providing communication between the suction passage 8 and the accommodation recessed portion 5*a* is eliminated, and instead, an introduction passage providing communication between the discharge passage 9 and the accommodation recessed portion 5*a* is formed.

Further, in the above embodiment, the radial passages 14 are provided as the two through holes passing through in the radial direction of the shaft 1. As long as the radial passages 14 provide communication between the axial passage 13 and the fourth connection passages 24, one radial passage 14 may be provided, plural radial passages 14 may be formed in a circumferential form, or the radial passages 14 may be not through holes.

Further, in the above embodiment, it is described that the fourth connection passages 24 connect the radial passages 14 and the second connection passages 22. Instead of this, the radial passages 14 may be directly connected to the second connection passages 22. In this case, the fourth connection passages 24 for lubrication may be provided or not provided in the second bearing 19.

Further, in the above embodiment, the first, second, third, and fourth connection passages 21, 22, 23, and 24 are the grooves provided in the bearings. Instead of this, the first, second, third, and fourth connection passages 21, 22, 23, and 24 may be gaps formed between the shaft 1 or the cylinder block 2 and the bearings.

Further, in a case where the grooves are formed as the first, second, third, and fourth connection passages 21, 22, 23, and 24, at least one groove may be provided for each of the connection passages. The second connection passage 22 may be provided in at least one of the pair of annular portions 19*b* of the second bearing 19. The fourth connection passage 24 may be provided in at least one of the pair of cylindrical portions 19*a* of the second bearing 19.

Further, the flange portion 1*c* projecting in a radially annular shape is formed in the shaft 1, and the second bearing 19 includes the annular portions 19*b* rotatably supporting the flange portion 1*c*. Instead of this, no flange portion 1*c* may be formed and the second bearing 19 may be a cylindrical bearing. In this case, holes or grooves may be formed in the radial direction of the bearing so as to serve as the second connection passages 22.

Further, plural guiding passages 15 may be provided in the front cover 4.

The circulation passage may be a passage with which the working fluid can be distributed in the pump, and may be appropriately changed in accordance with arrangement of the bearings and an internal structure of the pump. For example, in a case where a bearing is added, the passage may be provided so that the working fluid is also guided to the bearing.

This application claims priority based on Japanese Patent Application No. 2014-121314 filed with the Japan Patent Office on Jun. 12, 2014, the entire contents of which are incorporated into this specification.

The invention claimed is:

1. A piston pump configured to suction and discharge a working fluid, comprising:

a plurality of pistons;

a cylinder block including a plurality of cylinders configured to accommodate the pistons, the cylinder block being configured to be rotated;

a shaft configured to pass through the cylinder block, the shaft being combined with the cylinder block;

a swash plate configured to reciprocate the pistons in such a manner that capacity chambers of the cylinders are expanded and contracted in accordance with rotation of the cylinder block;

a casing configured to accommodate the cylinder block and support the shaft; and a valve plate placed between the cylinder block and the casing, wherein the cylinder block has communication holes configured to be opened on the cylinders, the casing has a suction passage through which the working fluid is guided to the capacity chambers through the communication holes, and a discharge passage to which the working fluid discharged from the capacity chambers through the communication holes is guided, the valve plate has a suction port configured to allow communication between the communication holes and the suction passage, and a discharge port configured to allow communication between the communication holes and the discharge passage, and the suction port is a cutout part corresponding to a gap in a substantially circular outermost edge of the valve plate.

2. The piston pump according to claim 1, wherein an inner circumferential surface defining a radially inner side of the suction port is provided on the radially inner side of an inner end of a trajectory on which the communication holes go in accordance with the rotation of the cylinder block.

3. A piston pump configured to suction and discharge a working fluid, comprising:

a plurality of pistons;

a cylinder block including a plurality of cylinders configured to accommodate the pistons, the cylinder block being configured to be rotated;

a shaft configured to pass through the cylinder block, the shaft being combined with the cylinder block;

a swash plate configured to reciprocate the pistons in such a manner that capacity chambers of the cylinders are expanded and contracted in accordance with rotation of the cylinder block;

a casing configured to accommodate the cylinder block and support the shaft; and a valve plate placed between the cylinder block and the casing, wherein the cylinder block has communication holes configured to be opened on the cylinders, the casing has a suction passage through which the working fluid is guided to the capacity chambers through the communication holes, and a discharge passage to which the working fluid discharged from the capacity chambers through the communication holes is guided, the valve plate has a suction port configured to allow communication between the communication holes and the suction passage, and a discharge port configured to allow communication between the communication holes and the discharge passage, the suction port is a through hole having an inner circumferential surface defining a radially inner side of the suction port, and an outer circumferential surface provided on the radially outer side of the inner circumferential surface, the outer circumferential surface is provided on the radially outer side of an outer end of a trajectory on which the communication holes go in accordance with the rotation of the cylinder block, and a width of the suction port between the inner circumferential surface and the outer circumferential surface in a radial direction, with respect to an axis of the shaft, is greater than a width of the communication holes in the radial direction.

4. The piston pump according to claim 3, wherein the inner circumferential surface of the suction port is provided on the radially inner side of an inner end of the trajectory on which the communication holes go in accordance with the rotation of the cylinder block.

5. The piston pump according to claim 1, further comprising:

a circulation passage through which the working fluid is circulated in the casing and the working fluid is returned to the suction passage, wherein the circulation passage has a return passage configured to communicate with the suction port.

6. A valve plate provided in a piston pump, the valve plate being placed between a cylinder block in which a cylinder configured to accommodate a piston is formed, the cylinder block being configured to be rotated together with a shaft, and a casing in which a suction passage through which a working fluid is guided into the cylinder and a discharge passage to which the working fluid discharged from the cylinder is guided are formed, the casing being configured to accommodate the cylinder block, the valve plate comprising:

a suction port connected to the suction passage; and a discharge port connected to the discharge passage, wherein the suction port is a cutout part corresponding to a gap in a substantially circular outermost edge of the valve plate.

7. A valve plate provided in a piston pump, the valve plate being placed between a cylinder block in which a cylinder configured to accommodate a piston is formed and a communication hole configured to be opened on the cylinder is formed, the cylinder block configured to be rotated together with a shaft, and a casing in which a suction passage through which a working fluid is guided into the cylinder and a discharge passage to which the working fluid discharged from the cylinder is guided are formed, the casing being configured to accommodate the cylinder block, the valve plate comprising:

a suction port configured to allow communication between the suction passage and the communication hole, the suction port having an inner circumferential surface and an outer circumferential surface; and a discharge port configured to allow communication between the discharge passage and the communication hole, wherein the outer circumferential surface of the suction port is provided on the radially outer side of an outer end of a trajectory on which the communication hole goes in accordance with rotation of the cylinder block, and a width of the suction port between the inner circumferential surface and the outer circumferential surface in a radial direction, with respect to an axis of the shaft, is greater than a width of the communication holes in the radial direction.

* * * * *